US010683071B2

(12) United States Patent
Aaron et al.

(10) Patent No.: US 10,683,071 B2
(45) Date of Patent: Jun. 16, 2020

(54) SUBMERGED COMPARTMENT FLUID TRANSFER SYSTEM

(71) Applicant: Global Aerospace Corporation, Irwindale, CA (US)

(72) Inventors: Kim M. Aaron, Irwindale, CA (US); Kerry T. Nock, Irwindale, CA (US)

(73) Assignee: Global Aerospace Corporation, Irwindale, CA (US)

( * ) Notice: Subject to any disclaimer, the term of this patent is extended or adjusted under 35 U.S.C. 154(b) by 0 days.

(21) Appl. No.: 16/162,245

(22) Filed: Oct. 16, 2018

(65) Prior Publication Data

US 2020/0115017 A1 Apr. 16, 2020

(51) Int. Cl.

| | |
|---|---|
| ***B63G 8/41*** | (2006.01) |
| ***B63B 22/02*** | (2006.01) |
| ***B63C 11/00*** | (2006.01) |
| *B63B 27/24* | (2006.01) |

(52) U.S. Cl.

CPC ..... *B63G 8/41* (2013.01); *B63B 22/021* (2013.01); *B63C 11/00* (2013.01); *B63B 27/24* (2013.01); *B63B 2022/028* (2013.01); *B63B 2702/12* (2013.01); *B63B 2728/00* (2013.01)

(58) Field of Classification Search

CPC ..... B63C 11/00; B63C 11/34; B63C 11/36; B63C 11/44; B63C 11/48

USPC ..... 114/312, 322; 405/190, 191

See application file for complete search history.

(56) References Cited

U.S. PATENT DOCUMENTS

| | | | | |
|---|---|---|---|---|
| 1,072,569 A * | 9/1913 | Cady | B63C 11/44 | 405/190 |
| 1,415,661 A * | 5/1922 | Lemon | B63C 11/44 | 405/190 |
| 4,245,578 A * | 1/1981 | Bianco | B63C 11/34 | 114/312 |
| 4,324,195 A * | 4/1982 | Cunningham | B63C 11/48 | 114/312 |

* cited by examiner

*Primary Examiner* — Lars A Olson

(74) *Attorney, Agent, or Firm* — Smyrski Law Group, A P.C.

(57) ABSTRACT

An apparatus for use with a submerged compartment is presented. The apparatus includes deployable physical connection hardware provided with the submerged compartment. The deployable physical connection allows for a transfer of fluid between the submerged compartment and a region near a marine free surface when deployed. The deployable physical connection hardware comprises a hose in one aspect.

19 Claims, 6 Drawing Sheets

SUBMERGED COMPARTMENT FLUID TRANSFER SYSTEM

BACKGROUND OF THE INVENTION

Field of the Invention

The present invention relates generally to submerged compartments and apparatus associated therewith, and more specifically to devices to transfer fluids between submerged compartments, or between a submerged compartment and a marine free surface such as an air-water interface of the sea, ocean, or body of fresh water.

Description of the Related Art

A distressed submarine (DISSUB) on the ocean bottom can, in many instances, have compartments with internal pressures of greater than 1 ata (atmosphere absolute). Flooding of the submarine by water can squeeze the air into a smaller volume, increasing the air pressure inside the compartment. The pressure in the compartment may also increase as a result of venting from high-pressure air banks due to damaged plumbing or crew use of emergency breathing apparatus.

The time required to get rescue crews to a DISSUB can be several days, especially if the DISSUB is in a remote ocean location, due to the need to assemble rescue infrastructure and crews and transport them to the DISSUB. During this time breathing air quality and pressure conditions inside the DISSUB can deteriorate.

Breathing of air at high pressures can significantly diminish the likelihood of survival for DISSUB crew members for three reasons. First, breathing of air at high pressure increases the solution of nitrogen in nerve membranes (nitrogen narcosis) that can cause impairment or incapacitation, similar to drugs or alcohol. Second, breathing air at high pressure tends to increase the concentration of oxygen in the body, which can be toxic to the central nervous system, lungs and eyes. Third, decompression sickness (the bends) caused by rapid decompression upon rescue can cause dissolved gases in the body to come out of solution forming bubbles that can cause severe pain, paralysis or death.

Pressurized naval rescue vehicles are not capable of transporting rescued personnel at pressures greater than 5 ata from the DISSUB to a surface ship, so a method of reducing the pressure inside a DISSUB to less than 5 ata to avoid decompression effects can be highly beneficial when the crew transfers to a rescue vehicle.

The air inside a submarine is typically maintained at 1 ata for crew safety and comfort. Therefore, as soon as a submarine submerges, the water pressure outside will be greater than the air pressure inside. If a DISSUB experiences increasing air pressure due to an accident, it can only vent excess air to the surrounding water passively as long as the air pressure inside is greater than the water pressure outside. For a survivable excess air pressure of 5 ata, this corresponds to a depth of about 132 feet. In many cases, a DISSUB could end up in much deeper water than 132 feet, so passive venting of excess air pressure to the surrounding water would not be possible.

Since a rescue-capable DISSUB could be located thousands of feet below the surface at pressures over 60 ata, reducing the pressure inside a DISSUB is a major challenge. No system currently exists that can be used directly by a DISSUB crew that meets naval requirements for addressing these pressure issues. Powered compressors capable of forcing air out of the compartment into the surrounding water at such high pressures present numerous challenges. Use of powered compressors would require significant power to raise the air pressure to more than 60 ata so that the air could be vented to the outside water rapidly. It is quite possible that whatever accident has disabled the submarine will also have disrupted the power system. A system that does not require power would be very attractive in this situation.

It is not possible for current rescue vessels to dock with a DISSUB in shallow water. The rescue vessel attaches itself to the top of the DISSUB using a large flexible seal, much like a giant suction cup. This flexible seal is held against the hull of the DISSUB around the hatch of an escape trunk built into the top of the DISSUB. An escape trunk is a small compartment on a submarine that provides a means for crew to escape from a DISSUB; it operates on a principle similar to an airlock, in that it allows the transfer of persons or objects between two areas of different pressure. With this arrangement, when the hatch is opened, the seal is held against the hull of the DISSUB by the pressure difference between the water on the outside of the seal pushing in and the lower air pressure inside the DISSUB pushing out. This pressure difference needs to be at least 5 atm in order to have a secure seal. Even with the DISSUB at normal 1 ata internal air pressure, a pressure difference of 5 atm corresponds to a hydrostatic pressure in the water of 6 ata, which is equivalent to a depth in water of about 165 feet. For each extra atmosphere of pressure inside the DISSUB, another 33 feet of depth is needed in order for the rescue vessel to attach securely to the hull of the DISSUB. For example, if the pressure inside the DISSUB were 5 ata, then the outside water would have to be at 10 ata. That is a depth of 330 feet. If a DISSUB were in this range of depths between 165 feet and 330 feet, having a way to vent the excess air to bring the air pressure down to a pressure at least 5 ata below the surrounding water pressure would enable the rescue vessel to attach securely and rescue the stranded submariners.

In light of the foregoing, it would be advantageous to offer a device that would be available to the crew of a submerged compartment for taking immediate independent action to offset the rate of increasing pressure, stabilize pressure or reduce the pressure of a submerged compartment even before rescue crews arrive, and decrease the risks associated with breathing air at high pressures in a DISSUB.

SUMMARY OF THE INVENTION

According to one aspect of the present design, there is provided a device that can control the rate of pressurization, equalize pressure or reduce the pressure, for use by a pressurized submerged vessel below a free marine surface. The device comprises a hose that provides a physical gas flow connection between the submerged vessel's pressurized volume and the free marine surface. The hose enables submerged vessel decompression by venting gas from the vessel and pressure equalization with the atmosphere at or near the marine free surface.

According to another aspect of the design, there is provided an apparatus for use with a submerged compartment, comprising deployable physical connection hardware provided with the submerged compartment. The deployable physical connection allows for a transfer of fluid between the submerged compartment and a region near a marine free surface when deployed. The deployable physical connection hardware comprises a hose in one aspect.

According to a further aspect, there is provided an apparatus, comprising a first submerged compartment, a second submerged compartment, and deployable physical connection hardware configured to facilitate transfer of fluid between the first submerged compartment and the second submerged compartment.

According to another aspect, there is provided an apparatus for use with a submerged compartment comprising physical connection hardware attachable to the submerged compartment wherein the physical connection hardware allows for a transfer of fluid between the submerged compartment and a region near a marine free surface.

According to a further aspect, there is provided a method comprising deploying physical connection hardware from a submerged vessel and transferring fluid from a submerged compartment of the submerged vessel using the physical connection hardware.

These and other advantages of the present invention will become apparent to those skilled in the art from the following detailed description of the invention and the accompanying drawings.

BRIEF DESCRIPTION OF THE DRAWINGS

The present invention is illustrated by way of example, and not by way of limitation, in the figures of the accompanying drawings in which.

Figure 1:
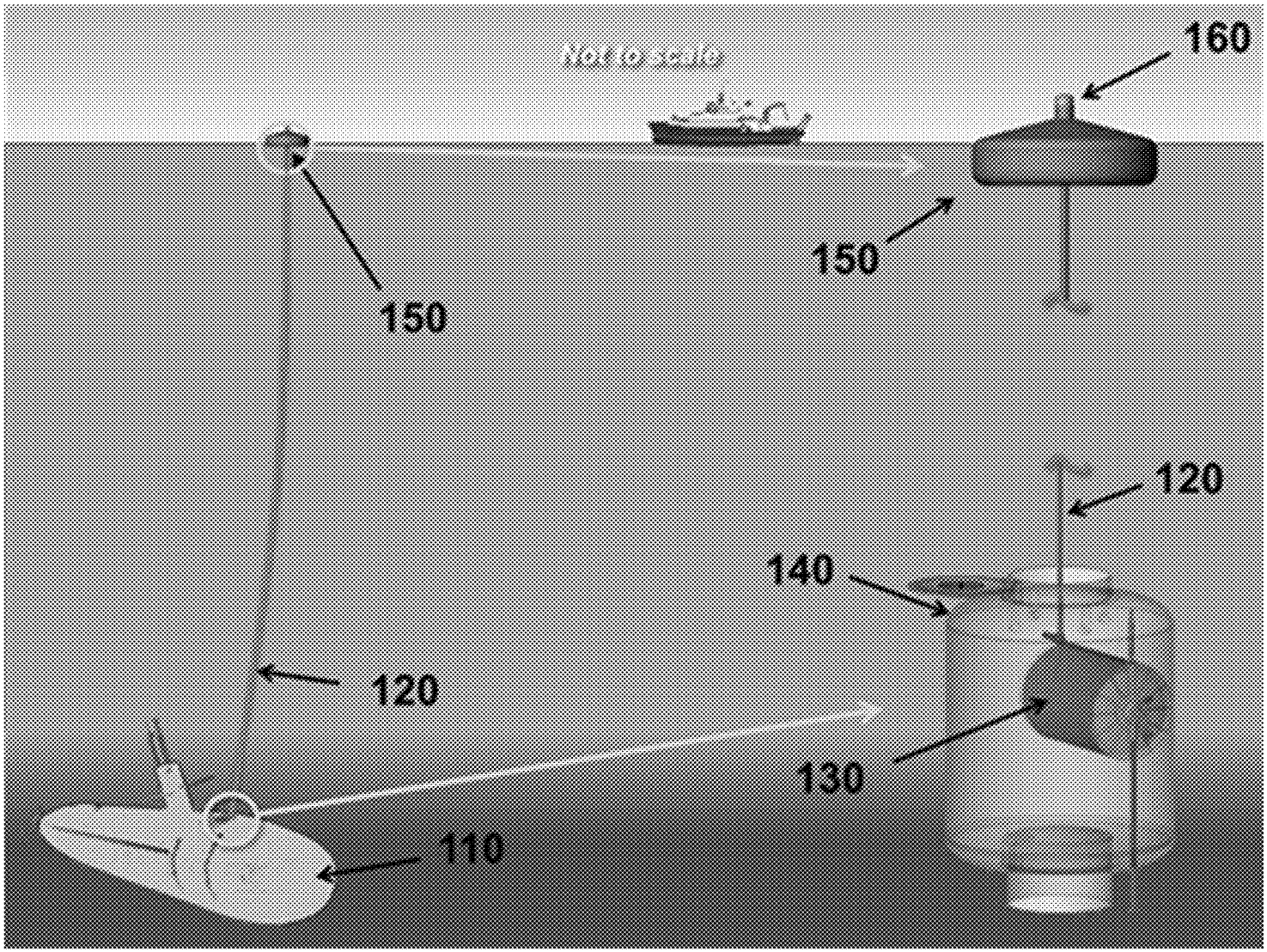
FIG. 1 illustrates an example of the use of the device and the various components of the apparatus.

The exemplification set out herein illustrates particular embodiments, and such exemplification is not intended to be construed as limiting in any manner.

DETAILED DESCRIPTION OF THE INVENTION

The following description and the drawings illustrate specific embodiments sufficiently to enable those skilled in the art to practice the system and method described. Other embodiments may incorporate structural, logical, process and other changes. Examples merely typify possible variations. Individual components and functions are generally optional unless explicitly required, and the sequence of operations may vary. Portions and features of some embodiments may be included in or substituted for those of others.

The present design is an apparatus or system that enables submerged compartment depressurization by creating a physical gas connection between the submerged vessel and the free marine surface. This technology enables a crew of a DISSUB to reduce the rate of pressure rise, or alternately stabilize the pressure, or depressurize a DISSUB compartment, making the air safer to breath while awaiting rescue. An important existing aspect of a submarine in context of the fluid transfer system is a submarine compartment escape trunk. A submarine compartment escape trunk, currently available on virtually all known submarines, is an air-lock between a submarine compartment and the external environment. An escaping DISSUB crew employs an escape trunk either to transport the crew to a submerged rescue vehicle or freely ascending to the ocean surface when the depth below the marine free surface is relatively small. Typical submarines have two or more escape trunks servicing two or more submarine compartments.

The present design controls the rate of pressurization, equalizing or reducing pressure, for use by a pressurized submerged vessel below a free marine surface. In one embodiment, the device comprises a hose that provides a physical gas flow connection between the submerged vessel's pressurized volume and the free marine surface. The hose enables submerged vessel decompression by venting gas from the vessel and pressure equalization with the atmosphere at or near the marine free surface. Alternately or in addition, the system may include a buoyant float that is released from the submerged vessel carrying one end of the hose to the free marine surface. A further aspect includes a reel on which the hose is wound prior to its release from the submerged vessel. In one aspect, the entire system, including hose, reel and float, is small enough to fit within a submarine escape trunk and can be moved from storage to and deployed from that location by the DISSUB crew. Alternately, the entire system including hose, float, and reel, may be built into a submarine, either as part of a new submarine design or as a retrofit of an existing submarine. In this arrangement, the system is available to a crew of a DISSUB upon over-pressurization or threat of over-pressurization. The entire system (hose, float, and reel) may be brought to the DISSUB and deployed by rescue crews to depressurize the DISSUB at the start of rescue operations, or may be brought to the DISSUB and placed in an escape trunk for connection, deployment and use by the DISSUB crew.

In one aspect, an arriving rescue crew may make a physical gas connection to the submerged compartment hose, which has been deployed to the free marine surface. The gas connection transfers air (using the hose) to the submerged compartment. In order to not increase pressure on board the DISSUB, gases may be exhausted from the DISSUB via a second hose. The submerged vessel may deploy two or more hoses to the free marine surface and the arriving rescue crew may make a physical gas connection to a first submerged compartment hose, now on the free marine surface, and transfer fresh air to the submerged compartment. The second hose enables the flow of poor quality air from the submerged vessel to the free marine surface. According to another aspect of the present design, the submerged vessel may deploy one or more hoses toward the free marine surface, where another submerged vessel or compartment makes a physical connection to the hose, thereby allowing the transfer of air from one submerged compartment to another submerged compartment.

In some circumstances, the device still provides benefit even if the free end of the hose does not reach the surface. The pressure inside the DISSUB may be at a pressure in excess of 1 ata, so gas may discharge to a lower pressure region somewhat below the marine free surface. A check-valve or device designed to perform a similar function allows gas to escape when the pressure inside the free end of the hose is greater than the pressure in the water surrounding the free end. One benefit of the hose described is that it can vent excess gas passively using just the natural pressure difference between the submerged compartment and the pressure near the marine free surface. In some circumstances, power may be available within the DISSUB. The hose may be connected to a pump to quickly discharge extra gas, or to discharge gas to a region deeper in the water than could be reached otherwise.

In another aspect, the exhaust of a diesel-powered generator or other device could be connected to the hose to vent exhaust gases. The air ingested by a diesel engine, combusted with the fuel, could also be expelled, reducing the compartment pressure in addition to powering an electrical generator.

Saturation divers operate from submerged structures that are not independently mobile and would not be considered to be a vessel. The invention, with its benefits, would be equally applicable to a submerged compartment employed in such a submerged structure.

In some circumstances, a hose connecting the marine free surface to a submerged compartment could be used to transfer liquids down the hose. For example, if fresh water supplies have been depleted inside the submerged compartment, rescue personnel at the marine free surface could introduce liquid water. The water would flow down the hose even while air is flowing up. Trapped occupants could capture the fresh water flowing out the bottom end of the tube. Nutritious liquids could similarly be transported down the tube in some emergency circumstances when rescue operations may be delayed significantly. A fluid is a gas or a liquid and the present design may serve as a fluid transfer system.

The design thus may use a hose to allow transfer of fluids between the near marine free surface and a submerged compartment that may be at significant depth in the water. The hose in most instances will be subjected to a large pressure difference tending to cause the hose to collapse. Therefore the hose is designed to. resist buckling type collapse due to external pressure.

FIG. 1 illustrates a distressed submarine (DISSUB) on the ocean bottom 110. Hose 120 extends from the DISSUB to the ocean surface. Reel 130, about which the hose 120 is wound and may be unreeled, is presented. A submarine escape trunk 140 is provided, from which the hose is deployed. Buoyant float 150 carries the hose to the ocean surface, and a vent valve cap 160 is employed to vent gas from the DISSUB.

Figure 2B:
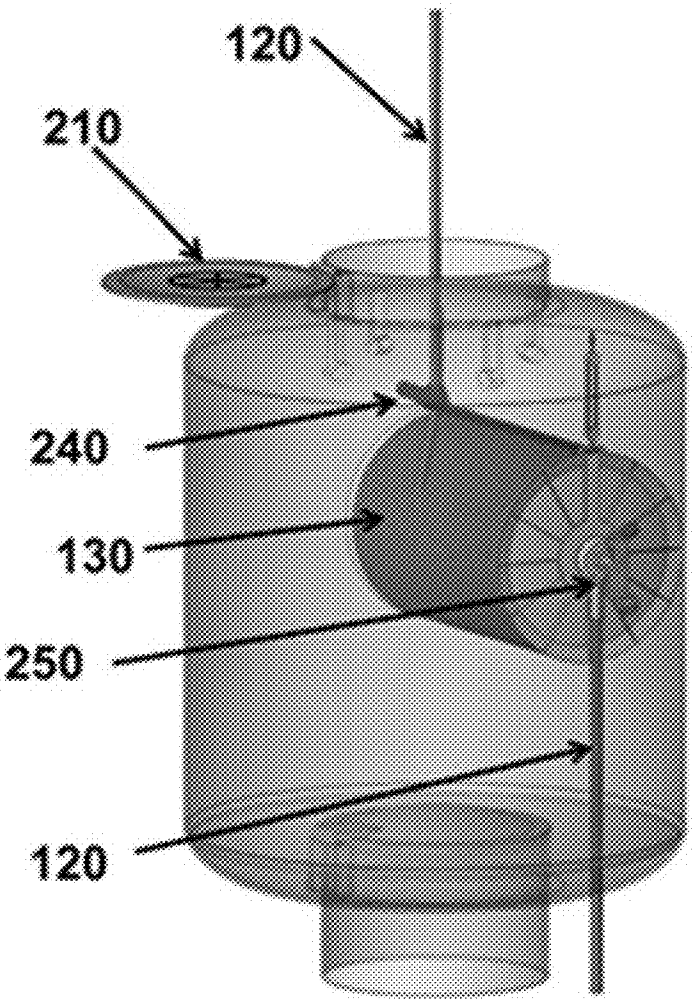
FIG. 2B shows an example of an escape trunk of a submerged compartment with the fluid transfer system already deployed from the escape trunk.
Figure 2A:
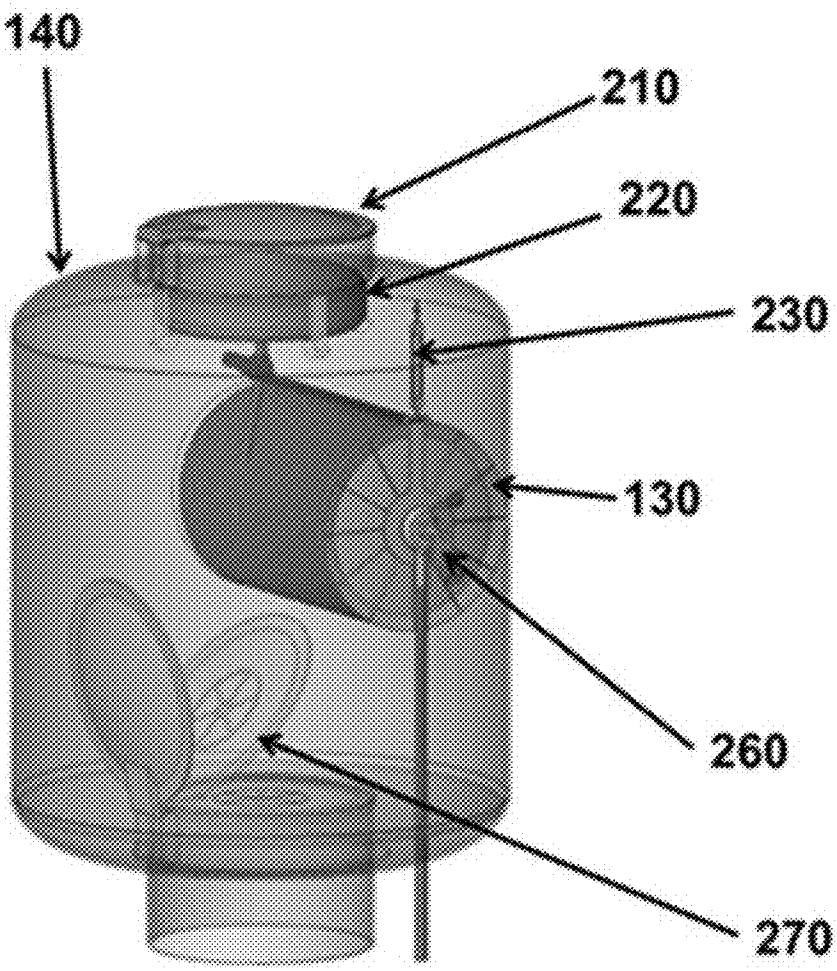
FIG. 2A is an example of an escape trunk of a submerged compartment with the fluid transfer system stowed and ready to deploy.

FIG. 2A illustrates a submarine escape trunk before deployment of the fluid transfer system. In FIG. 2A, the ascent-surface buoy 220 is mounted just below the upper escape hatch 210. Reel 130 is located at the top portion of the trunk with sufficient clearance for the lower escape hatch 270 to close. Reel hoists 230 are used by the crew to facilitate the raising the reel into place from lower escape hatch 270. Once hoisted into place, the reel is secured to the escape trunk by reel axle mounts 260, located on the sides of the trunk.

Once the reel is situated within the trunk, the surface-end is attached to a float, which could be a small buoy. A 29-inch diameter float, for example, can provide up to about 400 lb of positive buoyancy, which would be more than sufficient to unreel the hose. A deployment-guide sleeve can be attached below the top hatch to facilitate release of the buoy-mounted hose in maximum list and trim orientations. Once the compartment air connection is made, the trunk may evacuated of crew, flooded with seawater, and the top hatch opened remotely. Upon hatch opening, the buoy-mounted hose begins rising to the surface. As soon as the surface-end of the hose reaches a depth equal to the pressure of the compartment, air begins venting through the check valve. For example, if the compartment is at 5 ata, the hose begins venting at a depth of 132 ft. Full flow rate is achieved once the buoy-mounted hose is at the surface. An optional high-pressure-actuated hose cutter (e.g. guillotine) may be mounted on the deployment-guide sleeve to sever the hose connection once depressurization is completed so that a rescue vehicle can dock. Alternatively, the rescue vehicle may sever the hose using its own device.

FIG. 2B illustrates a submarine escape trunk after the fluid transfer system has been deployed. FIG. 2 shows upper escape hatch 210 opened, flooding the escape trunk, and releasing the ascent-surface buoy 220 to rise to the surface. The lower escape hatch 270 is closed in this instance. A continuous-rotation swivel 250 allows for reel rotation and the flow of gas under exterior pressure conditions. A remotely actuated hose cutter 240 is shown below the upper hatch, used to sever the hose in the event of rescue vehicle arrival and the need for docking with the escape trunk.

Figure 3B:
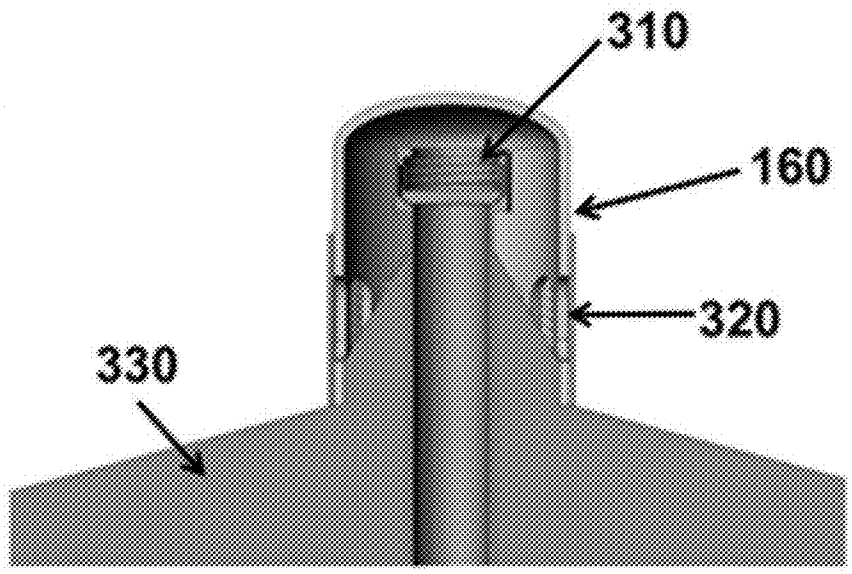
FIG. 3B shows an example buoyant float cutaway to illustrate the internal components.
Figure 3A:
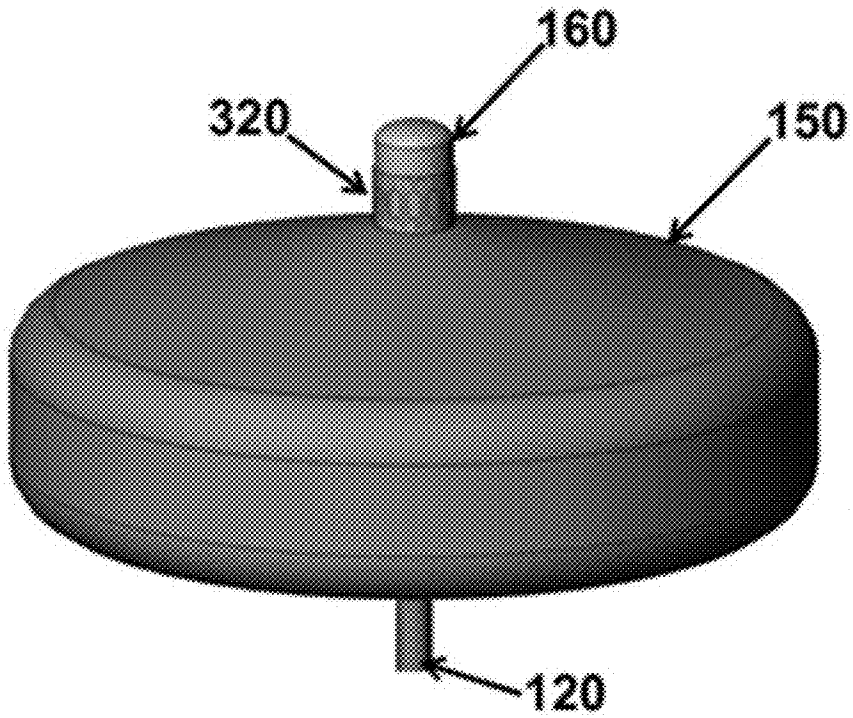
FIG. 3A illustrates an example buoyant float shown in perspective.

FIG. 3A shows the ascent-surface buoy with the vent valve cap 160 at the top and the hose 120 coming out the bottom. FIG. 3B illustrates the top of the buoy in cutout, with vent valve 310, vent holes 320, and buoyant foam 330.

Figure 4:
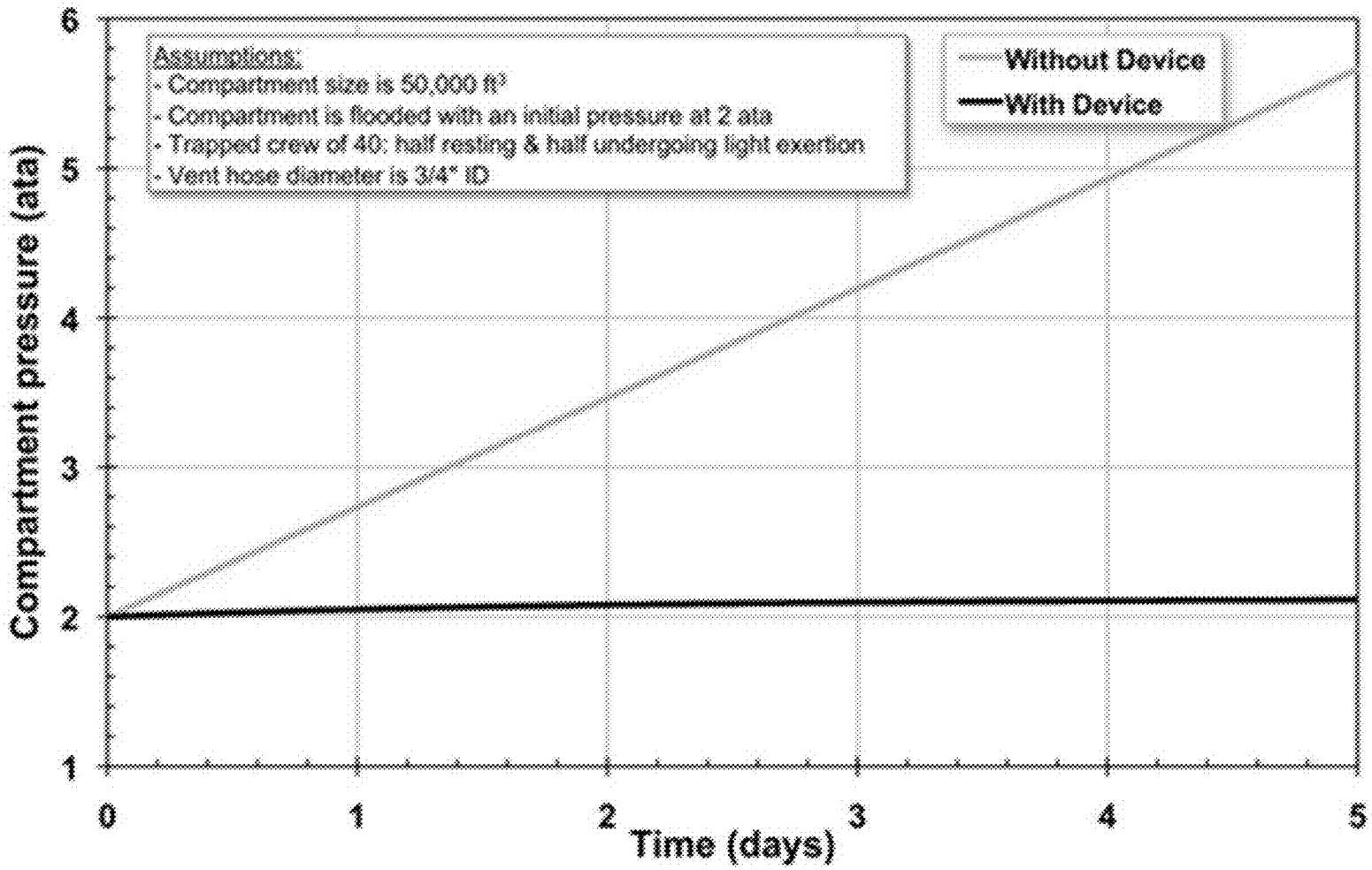
FIG. 4 is a graph of compartment pressure as a function of time in days that compares compartment pressures for a situation with and without the device presented herein.

FIG. 4 illustrates the pressure profile for one potential DISSUB scenario. In this scenario, an assumed 50,000 cubic feet compartment of the submarine has partially flooded and the air is foul, trapping 40 crewmembers and raising the pressure to 2 ata. The submarine sits on the bottom in 1,000 feet of water where the water pressure is about 30-times surface atmospheric pressure. Because the air is foul the trapped crew is using a built-in breathing system, a separate supply of breathing air, which is adding to the compartment pressure. For this scenario, the fluid transfer system can stabilize and maintain the compartment pressure at about 2 ata compared to the pressure without the system that reaches about 5 ata at 4 days. The submerged compartment fluid transfer system design includes a hose, a reel, a deployment-guide sleeve, a hose cutter, an ascent/surface buoy, check valves, and various items of plumbing.

Figure 5B:
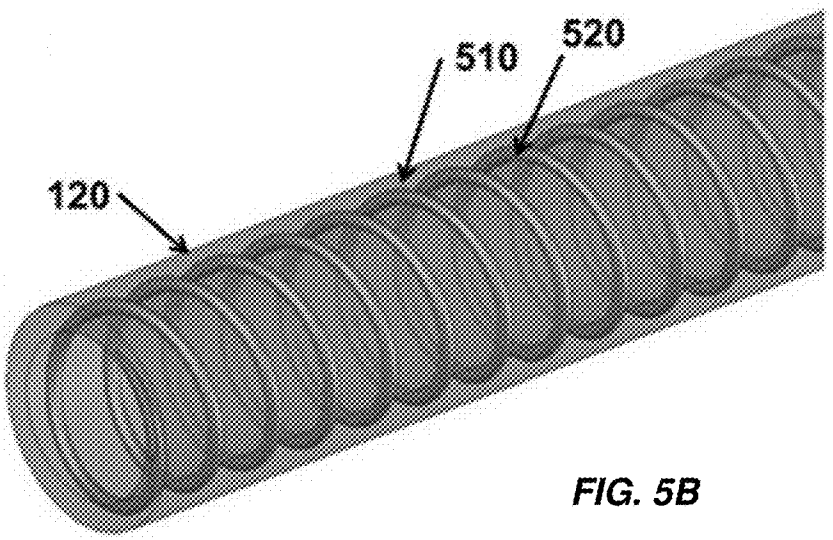
FIG. 5A and FIG. 5B illustrate an example hose wherein the hose is reinforced to prevent buckling due to external pressure.
Figure 5A:
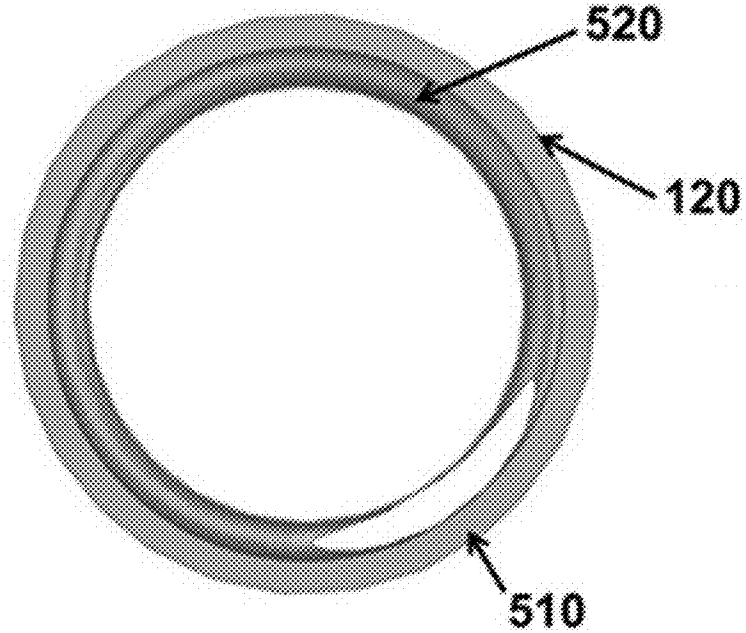

From FIGS. 5A and 5B, hose 120 provides the physical connection between the submerged compartment and the free marine surface. FIG. 5A shows the hose 120 in cross-section illustrating the nylon outer jacket material 510 in which an Inconel coil 520 or similar device or material, is embedded. Hose internal diameter (ID) can be a critical factor in determining the rate of fluid (air) transfer and compartment decompression. The hose design may have a 0.75-inch internal diameter in order to withstand an external pressure of about 60 bar (–900 psi). The factor of safety on external pressure is at least 1.5. The working internal pressure of the hose is between 1 and 5 bar. The working fluid of the present embodiment is air.

The hose preferably resists buckling (collapse) comfortably, where buckling would otherwise occur due to the external pressure at depth. Modeling indicates a hose segment made of a nylon 11 tube reinforced by a helical Inconel coil resists buckling loads at 60-bar pressure. The model assumes a Nylon 11 outer jacket with an elastic modulus of 0.4 GPa bonded to a metal coil with an elastic modulus of 200 GPa. The segment has an ID of 1 inch, OD of 1.25 inch, coil pitch of 0.3 inch, and a coil diameter of 0.0625 inch. Both 5% and 10% out-of-round (oval) geometries were generated to simulate unevenness that may result during fabrication or during long-term storage. The deformation and stress results for the 5% and 10% out-of-round geometries showed minimal deformation. For a 10% oval, expected peak deformation is on the order of 0.5 mm, peak stress level in the metal coil roughly 700 MPa, and peak stress in the outer jacket about 8 MPa. For the 5% oval case, the peak deformations are less than 0.375 mm and stress in the metal coil and outer jacket are reduced to 600 MPa and 4 MPa, respectively. In both the 5% and 10% out-of-round cases, the lowest load factor is about 1.7, so hose collapse pressure is 1500 psi. Resultant estimated factor of safety of the design with respect to pressure buckling is on the order of 1.7.

The hose reel is oriented horizontally inside a submarine compartment escape trunk, rotates as the hose unreels, and remains in the trunk until a rescue vehicle arrives. In operation, the crew hoists the reel vertically into the trunk using fixed mounts at the top of the trunk. Once inside, the crew rotates the reel horizontally and slides the axles into the fixed axle mounts on the side of trunk. For this embodiment of the design, the reel has a built-in friction force to prevent premature hose unreeling and entanglement.

Several reel design embodiments and corresponding functional operating options may be employed. Reel design embodiments may include: 1) trunk-fixed horizontal, rotating; 2) trunk-fixed vertical, rotating; 3) trunk-fixed vertical, non-rotating; 4) ascending through the water column, horizontal, rotating; 5) ascending through the water column, vertical, rotating, and 6) ascending through the water column, vertical, non-rotating. Other situations, including hybrid combinations of the above, may also occur.

For the trunk-fixed reel design embodiments, the reel may be mounted vertically if horizontal mounting is not feasible. Vertical orientation may require a fairlead and possibly a level wind to improve hose payout. A vertical reel must also clear the lower trunk hatch so the trunk hatch can be closed. Also, in the vertical orientation, the reel may rotate or remain stationary depending on circumstances. A stationary reel eliminates rotating high-pressure hose links. All of these represent viable design choices that are within the scope of the present invention.

In other design embodiments, the reel may be released from the trunk, after which the reel ascends to the surface while unreeling hose. In this class of design embodiments, the reel ascends in a vertical orientation or reorients horizontally after clearing the trunk hatch. Rotating and non-rotating designs may be employed. For some reel designs, using existing mounting points affixed inside the escape trunk may be advantageous. If needed, structural supports could be installed by the crew. The crew may also make hose connections to compartment air sources within the trunk before the lower hatch is closed. For the fixed-trunk system, a hoist and support structure may be employed to mount the reel and ascent-surface float within the trunk. Two design embodiments for the structure include a stand-alone structure able to be installed within the trunk and structural components mounted permanently within the trunk to reduce crew labor and facilitate installation of the reel and float.

In the case of a reel assembly design, a larger diameter reel may be assembled inside the trunk and later the hose could be wound onto the reel from below. Such a design may wind the hose by rotating the reel using a small motor-driven winch attached to the reel, where the winch operates like a conventional drill.

One function of the deployment-guide sleeve is to make sure the hose ascent-surface buoy deploys properly even with a large combination of DISSUB list and trim. A secondary function is to provide a mounting plane for the ascent-surface buoy. The inner surface of the deployment-guide sleeve may include a slippery material like Teflon. Also, when the reel is released to ascend while paying out the hose, such a sleeve can guide the reel out of the hatch to prevent snagging on an item of trunk hardware. The sleeve may guide the hose through a hose cutter mounted at the bottom of the sleeve to cut the hose when no longer needed or in the event of an emergency.

In the situation where a fluid transfer system has completed depressurization and rescue is imminent, the hose can be released or severed to allow the upper trunk hatch to close and enable the underwater rescue vehicle to dock with the DISSUB. Upon arrival, rescue divers, or a Remotely Operated Vehicle (ROV), can sever the hose. Alternatively, the DISSUB crew could sever the hose using a remotely actuated hose cutter (e.g. guillotine) mounted on the deployment-guide sleeve once depressurization is complete. The in-trunk cutter could also be used in the event of some unanticipated emergency that requires closing the upper trunk hatch. This device could be actuated by high-pressure air or water and thus could require additional connections to the escape trunk high-pressure sources, valves, and plumbing for operation by the crew. The cutter is designed to reliably sever the metal wire coil within the hose.

The reel out force required to overcome drag forces and hose payout time as a function of buoyant force imposed by the surface-end hose buoy can be estimated. A simple model assumes a reel bearing friction load of 20 lb, a rotating hose fitting load of 20 lb, and 5 lb load due to friction between the hose and the hose deployment-guide for a total of 45 lb or about 200 N. The trunk hatch diameter allows for a large buoyant force, up to 400 lb, assuming a spherical buoy of 29-inch diameter, which fits through a typical, and internationally standardized, 30 inches diameter escape hatch. In addition, the estimated net buoyancy force of the current hose design is about 0.12 lb/ft that results in a total buoyant force of nearly 240 lb (about 1000 N) for a fully deployed hose, not counting the ascent-surface buoy buoyancy. Initial estimates show that the hose will reel out in a few minutes, not counting hose self-buoyancy and hose profile drag due to coil shape, which will tend to have offsetting effects. The present ascent-surface buoy design has a buoyancy of about 130 lb (580 N) using commercially available buoyancy foam. In one aspect, the foam may be about 28 inches in diameter and 10 inches tall. The vent cover at the top is about 2.75 inches in diameter and 3.6 inches high and can sit on a cone to allow water to drain by gravity. The vent section may have a check valve at the top of a pipe that is connected to the hose. Below the valve in this embodiment are vent holes to the atmosphere. The vent holes may be covered with a hydrophobic mesh screen to reduce water splashing into the vent.

This buoy may include optional features such as satellite radio beacons and/or strobe lights. Continuous venting during large wave amplitudes may occur unimpeded. The buoy, along with its support structure (deployment-guide sleeve), is installed in the trunk, followed by the hose cutter and reel. Once the reel is installed, the hose may be attached to the buoy.

Various connectors, valves, high-pressure tubing and hose are employed to make the proper connections to the compartment air and high-pressure air banks in the trunk to ensure proper operation. Seawater ingestion into the hose could interfere with proper venting. At least two check valves may be included to prevent water ingestion, one at the surface end and one on the compartment air end of the hose.

Alternatively, manual valves may be incorporated to allow transfer of liquids down the hose as needed. For the trunk-fixed reel design embodiment, a rotating connector, e.g. an in-line swivel, can allow reel rotation despite external pressure (maximum of about 900 psi). Such devices are available for the marine oil and gas industry and are similar, conceptually, to the reels for typical residential garden hoses that operate with an internal hose pressure of about 100 psi.

If the compartment air connection in the trunk is smaller than the hose internal diameter, the trunk interface may be modified to be compatible with the hose to ensure a free flow of air out of the compartment. In addition, a low-profile structure may be added to the interior of the trunk to facilitate manually hoisting the reel into the trunk and to also support the reel axle. Without this additional permanent low-profile structure, additional hardware may need to be carried into and mounted within the trunk before the installing the reel.

Figure 6:
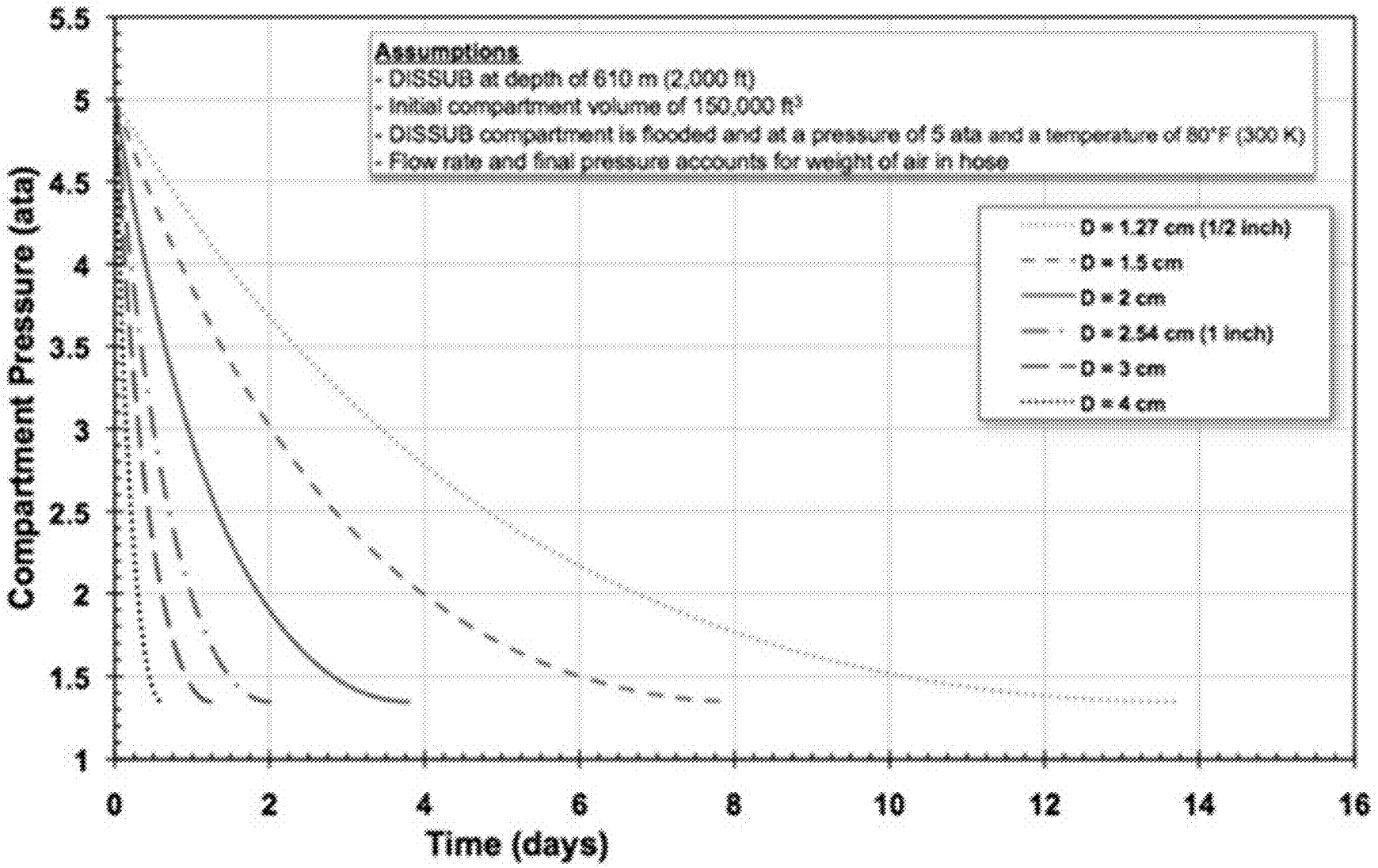
FIG. 6 is a graph of compartment pressure as a function of time in days for hoses of various internal diameters (ID).

FIG. 6 displays the preliminary tradeoff between decompression times and hose internal diameter for a flooded compartment (150,000 cubic feet). Air pressure is greater 2,000 ft below the surface due to the weight of the air inside the hose (atmospheric pressure increases below sea level). This determines the minimum compartment pressure of about 1.3 ata for this situation. When a compartment is flooded and pressurized to 5 ata, about 4/5 of the volume of gas would need to be removed to bring the pressure down to 1 ata. FIG. 6 shows that for this sized compartment, less than 4 days is needed to equalize the pressure with the surface atmosphere for a hose internal diameter of 2 cm. In most cases the decompression rate will be slow enough to not cause decompression sickness or the bends.

Thus according to one embodiment of the current design, there is provided an apparatus for use with a submerged compartment, comprising deployable physical connection hardware provided with the submerged compartment. The deployable physical connection allows for a transfer of fluid between the submerged compartment and a region near a marine free surface when deployed. The deployable physical connection hardware comprises a hose in one aspect.

According to a second embodiment, there is provided an apparatus, comprising a first submerged compartment, a second submerged compartment, and deployable physical connection hardware configured to facilitate transfer of fluid between the first submerged compartment and the second submerged compartment.

According to a third embodiment, there is provided an apparatus for use with a submerged compartment comprising physical connection hardware attachable to the submerged compartment wherein the physical connection hardware allows for a transfer of fluid between the submerged compartment and a region near a marine free surface.

According to a further embodiment, there is provided a method comprising deploying physical connection hardware from a submerged vessel and transferring fluid from a submerged compartment of the submerged vessel using the physical connection hardware.

The devices, processes and features described herein are not exclusive of other devices, processes and features, and variations and additions may be implemented in accordance with the particular objectives to be achieved. For example, devices and processes as described herein may be integrated or interoperable with other devices and processes not described herein to provide further combinations of features, to operate concurrently within the same devices, or to serve other purposes. Thus it should be understood that the embodiments illustrated in the figures and described above are offered by way of example only. The invention is not limited to a particular embodiment, but extends to various modifications, combinations, and permutations that fall within the scope of the claims and their equivalents.

The design presented herein and the specific aspects illustrated are meant not to be limiting, but may include alternate components while still incorporating the teachings and benefits of the invention. While the invention has thus been described in connection with specific embodiments thereof, it will be understood that the invention is capable of further modifications. This application is intended to cover any variations, uses or adaptations of the invention following, in general, the principles of the invention, and including such departures from the present disclosure as come within known and customary practice within the art to which the invention pertains.

The foregoing description of specific embodiments reveals the general nature of the disclosure sufficiently that others can, by applying current knowledge, readily modify and/or adapt the system and method for various applications without departing from the general concept. Therefore, such adaptations and modifications are within the meaning and range of equivalents of the disclosed embodiments. The phraseology or terminology employed herein is for the purpose of description and not of limitation.

What is claimed is:

1. An apparatus for use with a submerged pressurized compartment, comprising:

deployable fluid transfer hardware that resides with the submerged pressurized compartment;

wherein the deployable fluid transfer hardware allows for a transfer of fluid between the submerged compartment and the region near the marine free surface when deployed, and deployment occurs when pressure in the pressurized submerged compartment is at least two atmospheres absolute.

2. The apparatus of claim 1, wherein the deployable fluid transfer hardware comprises a fluid transfer hose.

3. The apparatus of claim 2, wherein the fluid transfer hose is shaped and constructed of materials configured to prevent collapse due to external pressure.

4. The apparatus of claim 1, wherein the pressurized submerged compartment is a component of a submarine vessel.

5. The apparatus of claim 4, further comprising a submarine escape trunk, wherein the deployable fluid transfer hardware is located in and deployable from the submarine escape trunk.

6. The apparatus of claim 5, wherein the deployable fluid transfer hardware comprises a fluid transfer hose configured to prevent collapse due to external pressure.

7. The apparatus of claim 6, wherein the fluid transfer hose in an undeployed configuration is stored on a reel within the pressurized submerged compartment.

8. The apparatus of claim 6, wherein the fluid transfer hose in an undeployed configuration is stored on a reel within the submarine escape trunk.

9. The apparatus of claim 1, wherein deployable fluid transfer hardware is physically attached to an exterior of a submarine.

10. An apparatus, comprising:

a first submerged pressurized compartment;

a second submerged pressurized compartment; and deployable fluid transfer hardware configured to facilitate transfer of fluid between the first submerged pressurized compartment and the second pressurized submerged compartment;

wherein deployment of the deployable fluid transfer hardware occurs when pressure in the first submerged pressurized compartment is at least two atmospheres absolute.

11. The apparatus of claim 10, wherein at least one of the first submerged pressurized compartment and the second submerged pressurized compartment is in a submarine.

12. The apparatus of claim 10, wherein the deployable fluid transfer hardware is initially outside a submarine and subsequently placed in an escape trunk of the submarine.

13. The apparatus of claim 10, wherein a buoyant float deploys the deployable fluid transfer hardware.

14. An apparatus for use with a pressurized submerged compartment comprising fluid transfer hardware attachable to the pressurized submerged compartment wherein the fluid transfer hardware when deployed allows for a transfer of fluid between the pressurized submerged compartment and the region near the marine free surface, wherein deployment of the fluid transfer hardware occurs when pressure in the pressurized submerged compartment is at least two atmospheres absolute.

15. A method comprising:

deploying fluid transfer hardware from a submerged vessel when pressure in the submerged vessel exceeds a predetermined limit above atmospheric pressure; and transferring fluid from a submerged compartment of the submerged vessel to the region near the marine free surface using the fluid transfer hardware.

16. A method as in claim 15, wherein the fluid transfer hardware comprises a hose.

17. A method as in claim 16, wherein the hose is configured to prevent buckling due to external pressure.

18. The method of claim 15, wherein the fluid is transferred to a region near a marine free surface when pressure in the submerged compartment is at least two atmospheres absolute.

19. The method of claim 15, wherein the fluid is transferred from the submerged compartment of the submerged vessel to a different submerged compartment.

* * * * *